US006272891B1

(12) United States Patent
Moen

(10) Patent No.: US 6,272,891 B1
(45) Date of Patent: Aug. 14, 2001

(54) KEYWAY PLUG FOR DOUBLE-SIDED KEYWAYS

(76) Inventor: Richard C. Moen, P.O. Box 1911, Brewster, MA (US) 02631

( * ) Notice: Subject to any disclaimer, the term of this patent is extended or adjusted under 35 U.S.C. 154(b) by 0 days.

(21) Appl. No.: 09/395,594

(22) Filed: Sep. 14, 1999

Related U.S. Application Data

(63) Continuation-in-part of application No. 08/989,721, filed on Dec. 12, 1997, now Pat. No. 5,950,466.

(51) Int. Cl.[7] ..... E05B 17/14
(52) U.S. Cl. ..... 70/428; 70/395; 70/398
(58) Field of Search ..... 70/358, 395, 398, 70/423–430

(56) References Cited

U.S. PATENT DOCUMENTS

| | | | |
|---|---|---|---|
| 1,696,326 | 12/1928 | Roethlisberger | 70/428 |
| 1,728,310 | 9/1929 | Sundel | 70/428 |
| 1,807,540 | 5/1931 | Makranczy | 70/428 |
| 2,068,936 | 1/1937 | Unterberg | 70/428 |
| 2,591,652 | 4/1952 | Ziegliss | 70/424 |
| 2,662,390 | 12/1953 | Michnoff et al. | 70/428 |
| 3,276,233 | 10/1966 | Russel et al. | 70/428 |
| 3,408,842 | 11/1968 | Barnes et al. | 70/428 |
| 4,120,184 | 10/1978 | Gerlach | 70/389 |
| 5,950,466 * | 9/1999 | Moen | 70/428 |

FOREIGN PATENT DOCUMENTS

| | | | |
|---|---|---|---|
| 289878 | 9/1986 | (FR) | 70/395 |
| 52-15799 | 5/1977 | (JP) | 70/395 |

* cited by examiner

*Primary Examiner*—Lloyd A. Gall
(74) *Attorney, Agent, or Firm*—Morse, Altman & Martin

(57) ABSTRACT

A keyway plug that provides a device for preventing the correct key from opening a double-sided tumbler lock, including a plug and an extractor. The plug fits into the keyway to block complete insertion of a key. In one embodiment, a pair of arms extend from the tip of the plug across both rows of tumblers, but is short enough so that the outermost tumblers drop to hide the plug. In the second plug embodiment, the outermost tumblers drops into a notch in the arms to prevent the plug from going too far into the keyway. Alternatively, only one arm has a notch. The extractor includes a narrow finger, each edge of which include a hook that mates with a matching hook in the inner edge of each plug arm. As the extractor is removed, the hooks interlock, causing the plug to be removed.

11 Claims, 4 Drawing Sheets

KEYWAY PLUG FOR DOUBLE-SIDED KEYWAYS

RELATED APPLICATIONS

The present application is a continuation-in-part application of application Ser. No. 08/989,721, dated Dec. 12, 1997 for KEYWAY PLUG in the name of Richard C. Moen U.S. Pat. No. 5,950,466.

FIELD OF THE INVENTION

The present invention relates to tumbler locks, more particularly, to a device for preventing a key from being inserted into a double-sided tumbler lock.

THE PRIOR ART

Tumbler locks have a variety of uses, the most prevalent being as building door locks and as automotive ignition and door locks. There are occasions when it is desired to prevent a tumbler lock from being opened, even by the correct key. For example, a worker is given a key to a room that is only to be used during normal business hours. Or a person is loaned a car, but is told not to open the trunk. Or a person renting a locker is behind in his/her rental payments. In all cases, the key will be able to open the lock at any time, but for some reason, the person in possession of the key is to be prevented from doing so.

Double-sided locks are becoming increasingly prevalent, particularly in motor vehicles. The position of the ignition switch on the steering column behind the steering wheel makes it difficult to see in order to orient the key. Double-sided locks have opposite sets of identical tumblers and use keys with identical cuts on each side so that the key can be inserted in either orientation and still work.

A number of devices have been developed over the years to prevent the correct key from opening a single-sided lock. Examples include U.S. Pat. No. 1,696,326 issued to Roethlisberger, U.S. Pat. No. 1,728,310 issued to Sundel, U.S. Pat. No. 2,068,936 issued to Unterberg, U.S. Pat. No. 3,408,842 issued to Barnes et al., U.S. Pat. No. 3,276,233 issued to Russell et al., and Japanese Pat. No. 52-15799 invented by Miyamae.

All of these devices will work on a double-sided lock. However, with the exception of Barnes et al., the convenience of being able to insert the keyway plug in either orientation is lacking because the extractor can only be used in one orientation relative to the plug. Consequently, one of the main advantages of using a double-sided lock disappears.

On the other hand, Barnes et al., in FIG. 6, discloses a keyway plug that can be used in a double-sided lock and the extractor can be used in either orientation. However, the plug of Barnes et al. has the problem in that it must be long enough to extend over all of the tumblers. If the outermost tumbler should drop in front of the plug, the plug could not be removed. The flat outer end of the plug would be caught against the tumbler and the flat end of the extractor could not be inserted past the tumbler.

SUMMARY OF THE INVENTION

An object of the present invention is to provide a keyway plug for preventing the correct key from opening a double-sided tumbler lock while retaining the convenience of the double-sided lock of inserting the key in either orientation.

The keyway plug of the present invention provides a means for preventing the correct key from opening a double-sides tumbler lock, while overcoming the deficiencies of the prior art. A double-sided tumbler lock includes a cylindrical barrel that rotates within a shell, a keyway, and a series of identical tumblers on opposite sides of the keyway. The key has identical cuts on both sides and causes the tumblers to align, permitting the barrel to rotate.

The keyway plug of the present invention includes a plug and an extractor. The plug fits into the double-sided keyway to block entrance of a key. Its tip is similar to the tip of an ordinary key. A pair of arms extend from the tip along both sides of the keyway. Unlike the plugs of the prior art, the arms of the first embodiment of the plug do not have to extend across all of the tumblers. It is preferred that the arms be short enough that the outermost tumbler drop in front of the plug, hiding it from casual inspection. To overcome the problem of the prior art plugs where the outermost tumbler prevents the plug from being removed with the extractor, the end of the arms have a chamfer to push the outermost tumblers out of the way upon extraction.

A second plug embodiment is for use in a lock where the plug could be pushed out the other end. Unlike the first embodiment, the arms extend to the outermost tumblers, which drop into notches in the outer edge of the arms. The outer edge of the notches is vertical to prevent the tumblers from sliding out of the notches, thus keeping the plug from moving farther into the keyway.

A third plug embodiment is a combination of the first two embodiments, where one arm has a notch for the outermost tumbler and the other arm is short enough to allow the outermost tumbler to extend fully into the keyway.

An extractor is used to remove the plug from the keyway. The extractor includes a narrow finger, each edge of which includes a hook that mates with a matching hook in the inner edge of the plug arms. As the extractor is being inserted into the keyway, the leading surface of the hooks forces the plug arms against the tumblers. When the extractor and plug hooks become aligned, the tumblers push the plug back against the extractor, and when the extractor is pulled from the keyway, the hooks mate to pull the plug from the keyway.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION

The keyway plug of the present invention provides a means for preventing the correct key from opening a double-sides tumbler lock. There are several different types of double-sided tumbler locks, including pin tumblers, disc tumblers, and sidebar tumblers. The figures of the present disclosure show the present invention in operation with a pin tumbler lock. However, these figures are intended to be illustrative only, and it is contemplated that the present invention will be used with any type of double-sided tumbler lock available.

Figure 1:
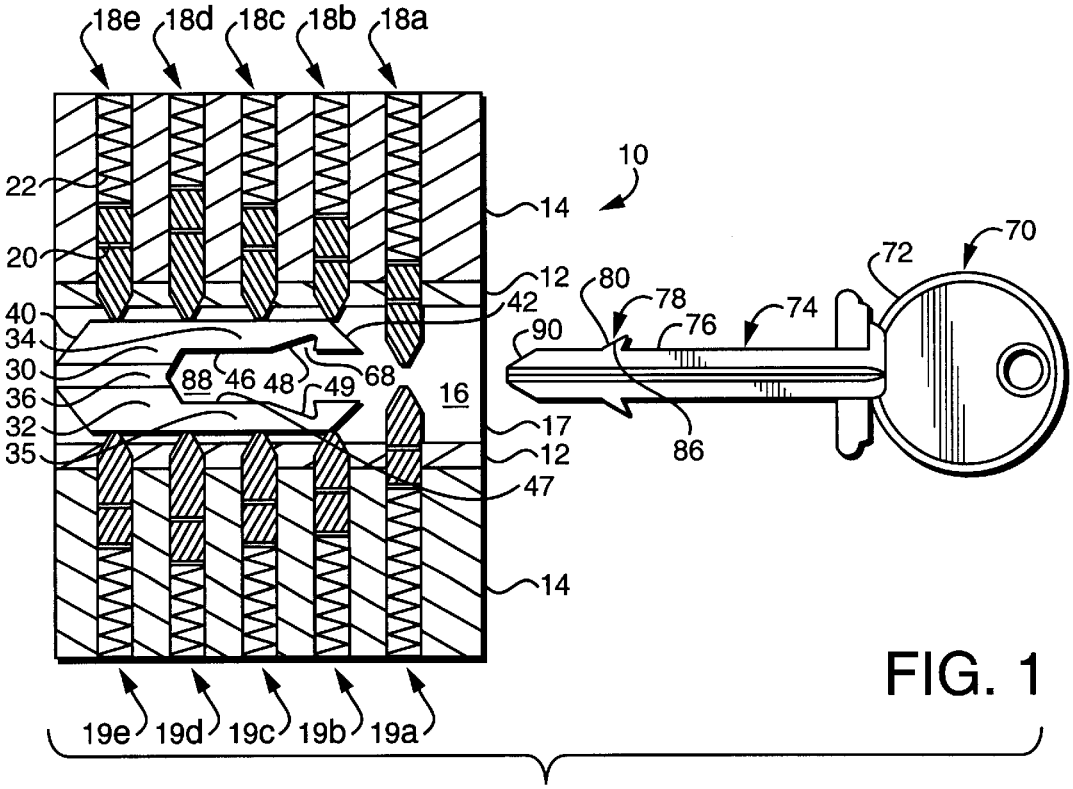
FIG. 1 shows a cross-sectional side view of the double-sided pin tumbler lock with one embodiment of the present invention installed.

FIG. 1 illustrates a typical double-sided tumbler lock 10, here a pin tumbler lock, with which the present invention will be used. The lock 10 includes a cylindrical barrel 12 that rotates within a shell 14, a keyway 16, and a dual series of pin tumblers 18*a*–18*e*, 19*a*–19*e*. When the correct key (not shown) is inserted into the keyway 16, the pin tumblers 18, 19 are arranged so that the shear line 20 of all the tumblers 18, 19 are aligned, permitting the barrel 12 to rotate. Disc tumblers and sidebar tumblers operating in a slightly different manner, but all rely on the correct key aligning the tumblers to permit the barrel to rotate. When no key is inserted, a spring 22 biases the tumblers 18, 19 into the keyway 16.

Figure 2:
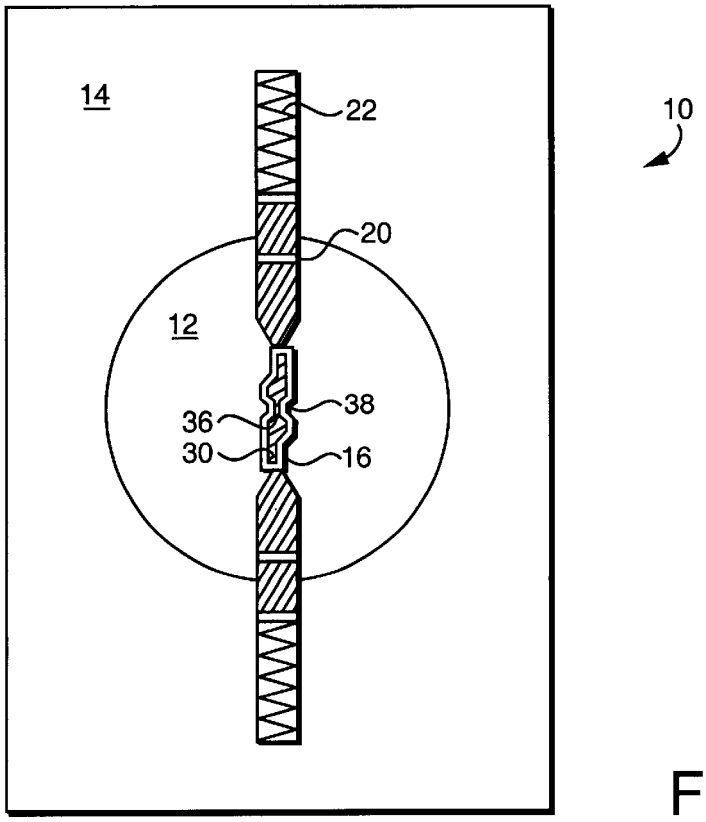
FIG. 2 shows a cross-sectional end view of the plug and keyway of FIG. 1.

The keyway plug of the present invention has at least two components, a plug 30 and an extractor 70. The purpose of the plug 30 is to prevent the key from being completely inserted into the keyway, keeping the tumblers 18, 19 misaligned. As seen in FIG. 1, the plug 30 comprises a tip 32 and a pair of arms 34, 35. The end profile of the lock 10 and plug 30, shown in FIG. 2, shows that the plug 30 has grooves 36 to match ridges 38 in the profile of the keyway 16. The tip 32 has the same height as an ordinary key so that it can be inserted into the keyway 16 without having to jiggle it up and down to find the grooves 36. The tip 32 is similar to the tip of an ordinary key. It includes chamfers 40 that push the tumblers 18, 19 out of the way when the plug 30 is inserted into the keyway 16.

A pair of plug arms 34, 35 extend away from the tip 32 along the direction of the keyway 16, with a gap 88 in between. Unlike the plugs of the prior art, the arms 34, 35 of the embodiment of FIG. 1 do not have to extend over all of the tumblers 18, 19. It is preferred that the arms 34, 35 be short enough that the outermost tumblers 18*a*, 19*a* extend fully into the keyway 16 in front of the plug 30, hiding it from casual inspection. To overcome the problem of the prior art plugs where the outermost tumblers prevent the plug from being removed with the extractor, the end of each arms 34, 35 has a chamfer 42.

Figure 3:
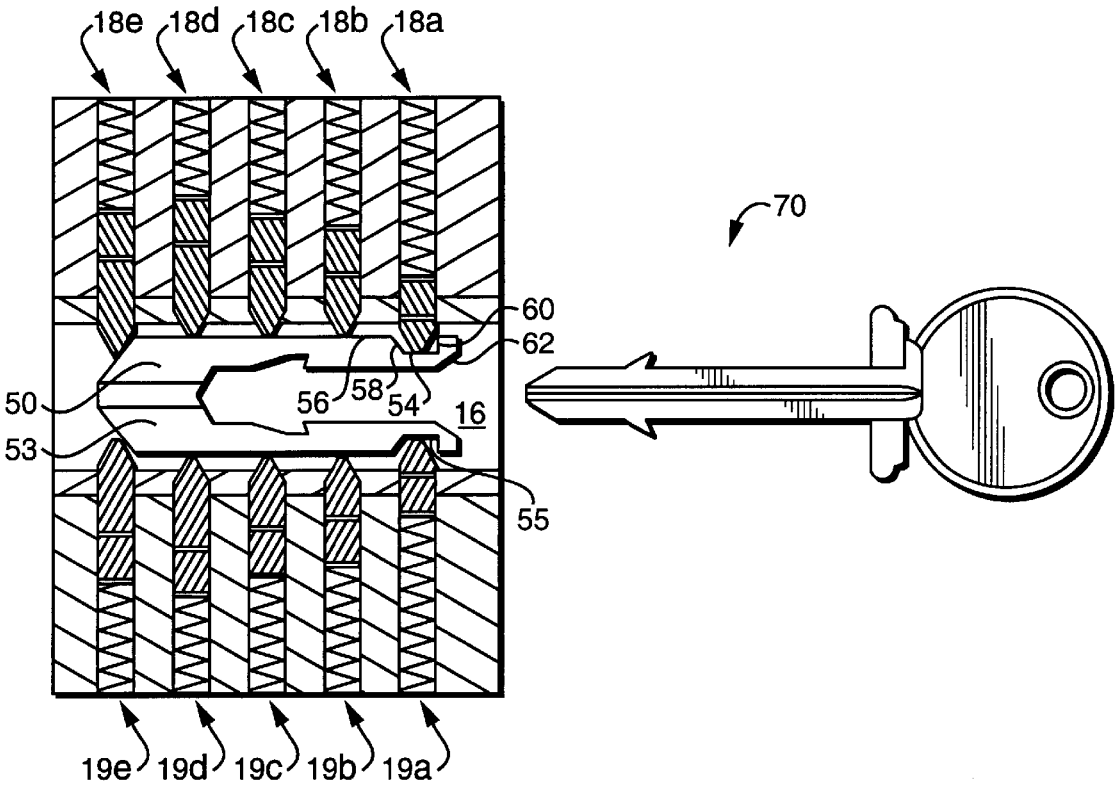
FIG. 3 shows a cross-sectional side view of the double-sided pin tumbler lock with a second embodiment of the present invention installed.

A second embodiment of the plug 50 is for use in a lock where the keyway 16 is not closed at its inner end, and is shown in FIG. 3. Unlike the embodiment of FIG. 1, the arms 52, 53 extend to the outermost tumbler 18*a*, 19*a*. The arms 52, 53, however, do not have to extend across all of the innermost tumblers 18*b*–18*e*, 19*b*–19*e*. As the plug 50 is inserted into the keyway 16, the outermost tumbler 18*a*, 19*a* drops into a notch 54 in the arms' surface 56. The leading edge 58 of the notch 54 is sloped to allow the outermost tumbler 18*a*, 19*a* to slide into and out of the notch 54. The trailing edge 60 is vertical enough to prevent the tumbler 18*a*, 19*a* from sliding out of the notch 54, thus keeping the plug 50 from being pushed too far into the keyway 16. In addition, the outer corner of the arm 58 has a chamfer 62 to make it more difficult to pry the plug 50 from the keyway 16.

Figure 4:
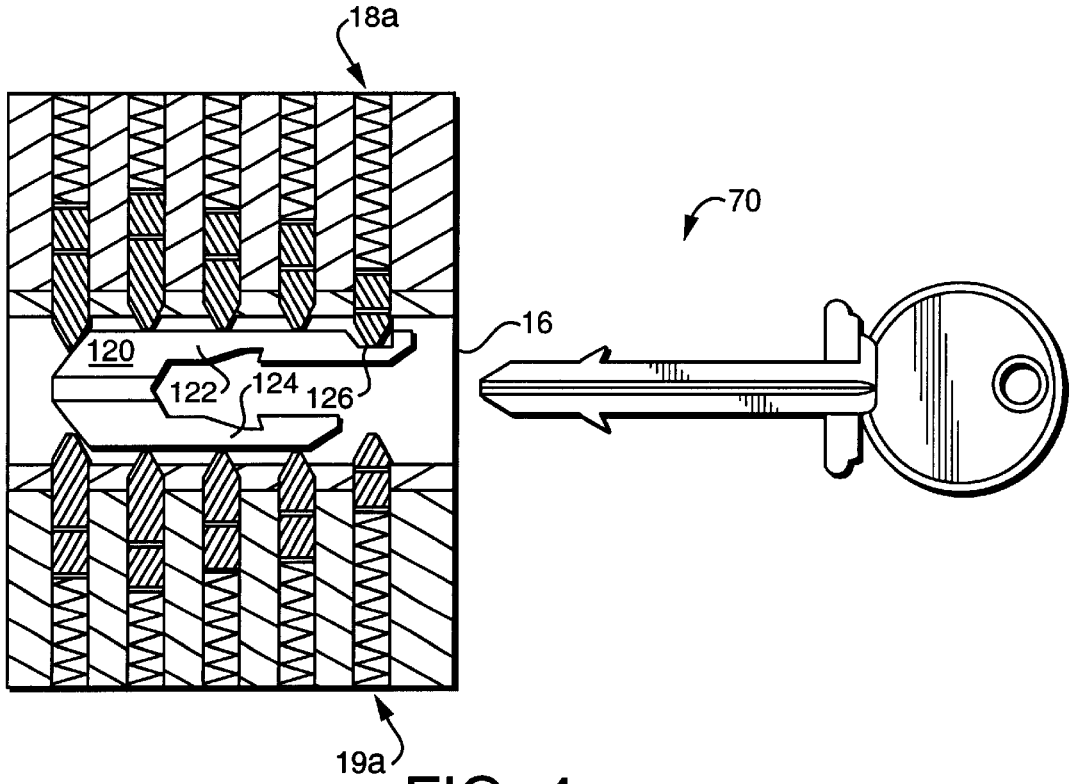
FIG. 4 shows a cross-sectional side view of the double-sided pin tumbler lock with a third embodiment of the present invention installed.
Figure 5:
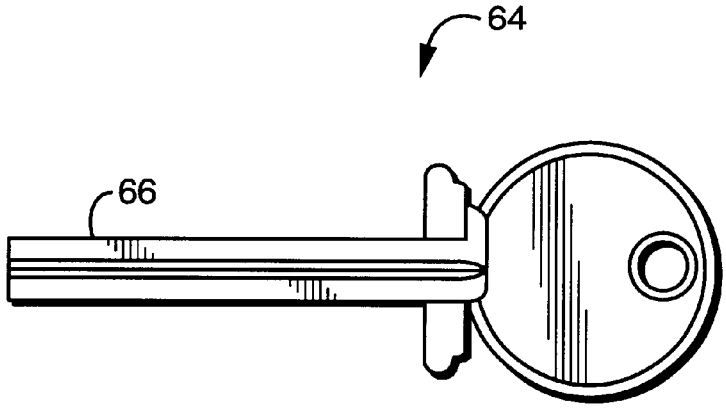
FIG. 5 shows a side view of an inserter.

A third embodiment, shown in FIG. 4, is basically a combination of the first two embodiments. One arm 122 of the plug 120 has a notch 126 into which one outermost tumbler 18*a*drops into and the other arm 124 is short enough so that the other outermost tumbler 19*a* drops fully into the keyway 16.

The remainder of this detailed description refers specifically to the first plug embodiment 30 of FIG. 1. Unless specified otherwise, the remainder of this detailed description also applies to the second plug embodiment 50 of FIG. 3.

The plug 30 is inserted into the keyway 16 by placing it in the entrance 17 to the keyway 16 and pushing it into the keyway 16 until it stops, either by reaching the end of the keyway 16, as in FIG. 1, or by the outermost tumbler 18*a*, 19*a* dropping into the notch 54, 55, as in FIG. 3. The plug 30 is initially placed and started into the keyway 16 manually. Once the plug 30 is inserted a small distance, to the point where a person's finger cannot push it in farther, a tool, such as the regular key or a key blank, must be used to push it in the rest of the way. Optionally, an inserter 64, shown in FIG. 4, is provided. The inserter finger 66 needs to be long enough to push the plug 30 all the way into the keyway 16. The inserter 64 is removed from the keyway 16 after the plug 30 is fully inserted.

Figure 6:
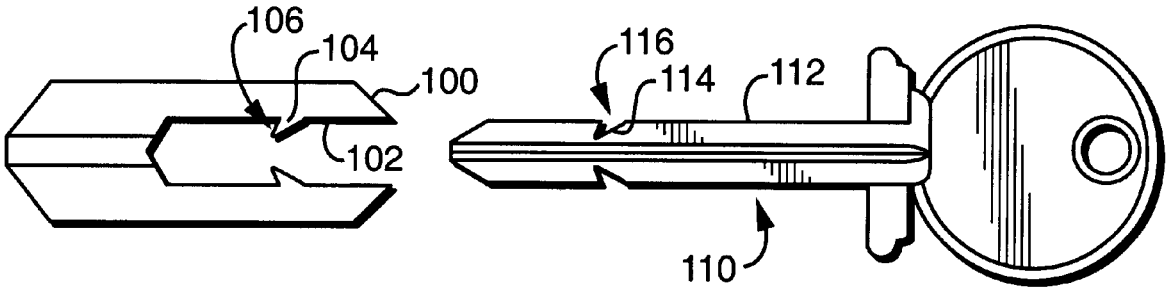
FIG. 6 shows a side view of an alternate embodiment of the hooks.

The plug 30 is removed from the keyway 16 by an extractor 70, shown in FIG. 1. The extractor 70 includes a head 72 for grasping, like that of a regular key. A finger 74 extends from the head 72. The height of the finger 74 is approximately the same as the gap 88 between the arms 34, 35. The end 90 of the finger 74 is preferably tapered to facilitate insertion into the gap 88. The edges 76 of the finger 74 include a hook 78 that mates with a matching hook 48, 49 in the inner edge 46, 47 of the plug arm 34, 35, as in FIG. 1. The leading edge 80 of the extractor hook 78 is chamfered to facilitate insertion of the extractor 70 into the plug gap 88. FIG. 1 shows an arrangement where the plug hook 48 is formed by a shaped notch 68 in the inner edge of the arm and the extractor hook 78 is formed by a shaped protrusion 86. Alternatively, FIG. 6 shows an arrangement in which the plug hook 106 is formed by a shaped protrusion 104 from the inner edge 102 of the arm 100, and the extractor hook 116 is formed by a shaped notch 114 in the edge 112 of the extractor finger 110.

Figure 7:
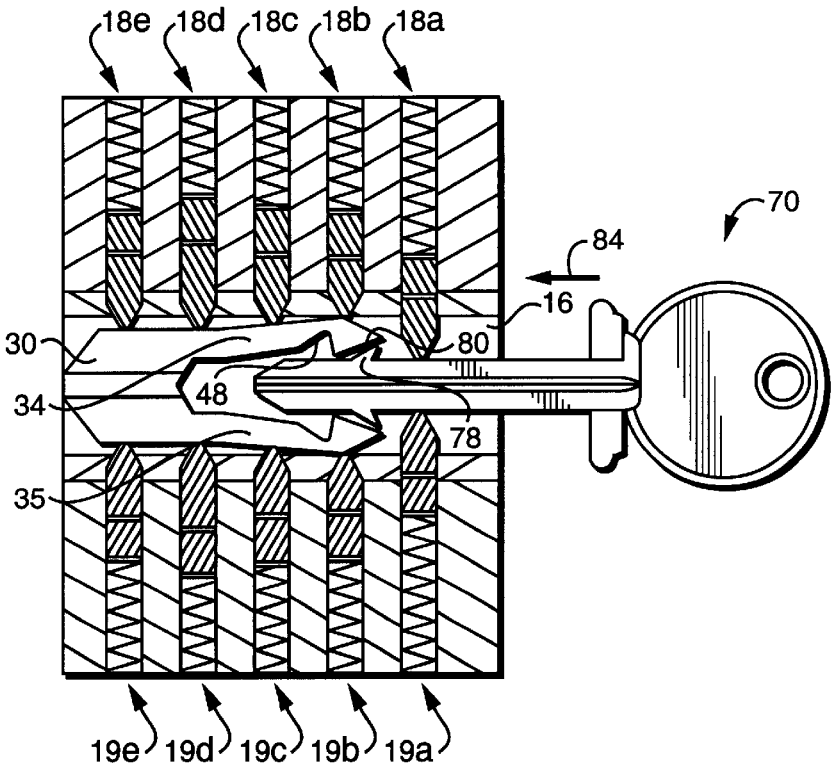
FIG. 7 shows a cross-sectional side view of the beginning of the extraction procedure.

The plug 30 is removed by inserting the extractor 70 into the keyway 16 and pushing it against the plug 30, as at 84. As the extractor 70 continues to be pushed farther into the keyway 16, the chamfered surface 80 of the extractor hooks 78 force the arms 34, 35 against the tumblers 18*b*–18*e*, 19*b*–19*e*, as in FIG. 7. The arms 34, 35 will move because of the play between the keyway 16 and plug 30. As shown in the profile of FIG. 2, there are matching pair of grooves 36 and ridges 38 between the plug 30 and keyway 16. However, because these pairs are loosely fit, the plug 30 can move vertically a small amount relative to the keyway 16. Consequently, the height of the extractor hooks 78 must not be larger than the greatest vertical displacement of the plug 30 in the keyway 16. If necessary, a loose fit is provided by extra-wide grooves 36 on the plug 30.

Figure 8:
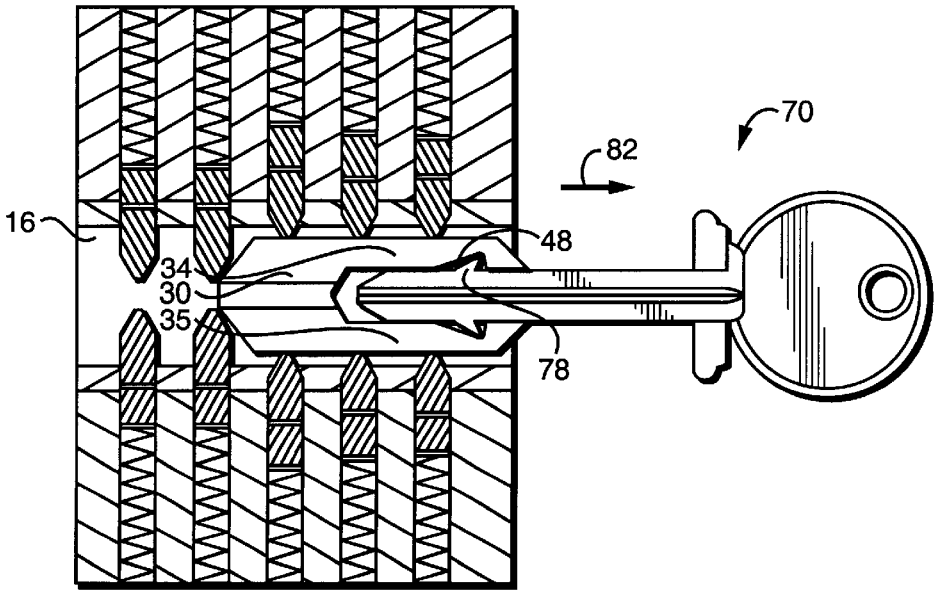
FIG. 8 shows a cross-sectional side view of the end of the extraction procedure.

While the extractor 70 is being inserted, the spring-loaded tumblers 18*b*–18*e*, 19*b*–19*e* are pushing against the arms 34, 35. When the hooks 48, 78 become aligned, the tumblers 18*b*–18*e*, 19*b*–19*e* push the arms 34, 35 back down against the extractor finger 74, and when the extractor 70 is pulled from the keyway 30, as at 82, the hooks 48, 78 mate, pulling the plug 30 from the keyway 16, as in FIG. 8.

Thus it has been shown and described a keyway plug which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A keyway plug for use with a double-sided tumbler lock having a keyway with an entry into which a key is inserted and opposing sets of tumblers extending into said keyway, each of said sets of tumblers including an outermost tumbler adjacent to said entry, said keyway plug comprising:

(a) a plug having a tip and a pair of arms extending therefrom to free ends remote from said tip, each of said arms including an outer edge in contact with said tumblers when installed in said keyway and an inner edge having a hook, said plug being completely within said keyway when installed;

(b) an extractor including a grasping head and a finger, said finger having a pair of opposed edges, each of said opposed edges having a hook; and (c) said extractor hooks adapted to mate with said plug hooks to remove said plug from said keyway when said extractor finger is inserted into and then removed from said keyway.

2. The keyway plug of claim 1 wherein said plug is adapted to fit into said keyway such that said outermost tumblers extend fully into said keyway and said arms have a chamfer at said free end thereof adapted to push said outermost tumblers out of said keyway when said plug is being removed from said keyway.

3. The keyway plug of claim 1 wherein said arms outer edge includes a notch adapted to permit passage of said outermost tumbler into said notch as said plug is inserted into said keyway, to prevent passage of said outermost tumbler out of said notch as said plug is inserted into said keyway, and to permit passage of said outermost tumbler out of said notch as said plug is being removed from said keyway.

4. The keyway plug of claim 1 wherein said arm hooks are formed by a notch in said arm inner edge and said extractor hooks are formed by a protrusion on said finger edge.

5. The keyway plug of claim 1 wherein said arm hooks are formed by a protrusion on said arm inner edge and said extractor hooks are formed by a notch in said finger edge.

6. A keyway plug for use with a double-sided tumbler lock having a keyway with an entry into which a key is inserted and opposing sets of tumblers extending into said keyway, each of said sets of tumblers including an outermost tumbler adjacent to said entry, said keyway plug comprising:

(a) a plug having a tip and a pair of arms extending therefrom to free ends remote from said tip, each of said arms including an outer edge in contact with said tumblers when installed in said keyway and an inner edge having a hook;

(b) said plug being adapted to fit into said keyway such that said outermost tumblers extend fully into said keyway and said arm free ends have a chamfer adapted to push said outermost tumblers out of said keyway when said plug is being removed from said keyway;

(c) an extractor including a grasping head and a finger, said finger having a pair of opposed edges, each of said opposed edges having a hook; and (d) said extractor hooks adapted to mate with said plug hooks to remove said plug from said keyway when said extractor finger is inserted into and then removed from said keyway.

7. The keyway plug of claim 6 wherein said arm hooks are formed by a notch in said arm inner edge and said extractor hooks are formed by a protrusion on said finger edge.

8. The keyway plug of claim 6 wherein said arm hooks are formed by a protrusion on said arm inner edge and said extractor hooks are formed by a notch in said finger edge.

9. A keyway plug for use with a double-sided tumbler lock having a keyway with an entry into which a key is inserted and opposing sets of tumblers extending into said keyway, each of said sets of tumblers including an outermost tumbler adjacent to said entry, said keyway plug comprising:

(a) a plug having a tip and a pair of arms extending therefrom to free ends remote from said tip, each of said arms including an outer edge in contact with said tumblers when installed in said keyway and an inner edge having a hook;

(b) said outer edge of each of said arms including a notch having a leading edge and a trailing edge, said leading edge permitting passage of said outermost tumbler into said notch as said plug is inserted into said keyway and permitting passage of said outermost tumbler out of said notch as said plug is removed from said keyway, said trailing edge preventing passage of said outermost tumbler out of said notch when said plug is inserted completely into said keyway;

(c) an extractor including a grasping head and a finger, said finger having a pair of opposed edges, each of said opposed edges having a hook; and (d) said extractor hooks adapted to mate with said plug hooks to remove said plug from said keyway when said extractor finger is inserted into and then removed from said keyway.

10. The keyway plug of claim 9 wherein said arm hooks are formed by a notch in said arm inner edge and said extractor hooks are formed by a protrusion on said finger edge.

11. The keyway plug of claim 9 wherein said arm hooks are formed by a protrusion on said arm inner edge and said extractor hooks are formed by a notch in said finger edge.

* * * * *